United States Patent [19]

Thomanek

[11] 4,374,495

[45] Feb. 22, 1983

[54] WARHEAD FOR ANTITANK MISSILES FEATURING A SHAPED CHARGE

[76] Inventor: Franz R. Thomanek, Am Schlosskeller 23, D-8898 Schrobenhausen-Sandizell, Fed. Rep. of Germany

[21] Appl. No.: 946,041

[22] Filed: Sep. 12, 1978

[30] Foreign Application Priority Data

Sep. 17, 1977 [DE] Fed. Rep. of Germany ..... 2741984

[51] Int. Cl.[3] ..... F42B 13/10

[52] U.S. Cl. ..... 102/476; 102/306; 102/310

[58] Field of Search ..... 102/56 SC, 24 HC, 253, 102/480, 305–310, 473, 475, 476

[56] References Cited

U.S. PATENT DOCUMENTS

| | | | |
|---|---|---|---|
| 2,605,704 | 8/1952 | Dumas | 102/56 SC |
| 3,016,014 | 1/1962 | Lebourg | 102/24 HC |
| 3,398,916 | 8/1968 | Van Vyve | 102/476 |
| 3,732,818 | 5/1973 | Thomanek | 102/56 SC |
| 4,178,851 | 12/1979 | Brady | 102/24 HC |
| 4,262,596 | 4/1981 | Allier et al. | 102/476 |

FOREIGN PATENT DOCUMENTS

| | | | |
|---|---|---|---|
| 545870 | 3/1956 | Belgium | 102/56 SC |
| 1432578 | 2/1966 | France | 102/56 SC |
| 89303 | 6/1967 | France | 102/56 SC |

*Primary Examiner*—Harold J. Tudor

*Attorney, Agent, or Firm*—Antonelli, Terry and Wands

[57] ABSTRACT

An improved warhead of the type having at least one shaped charge is formed by the shaped charge or charges being positioned within the warhead so that the longitudinal axis of the charge forms an angle of 15 to 50 degrees with respect to the axis of the warhead in its stabilized in-flight attitude.

31 Claims, 27 Drawing Figures

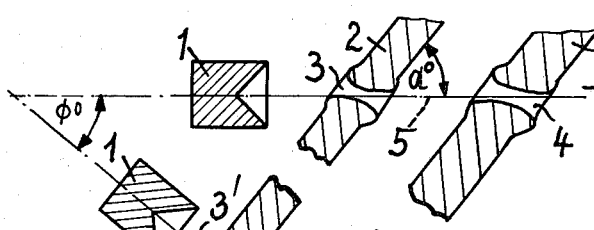
FIG. 1
PRIOR ART
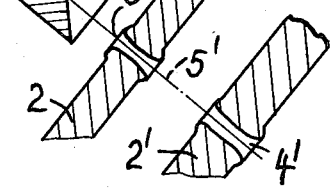
FIG. 2
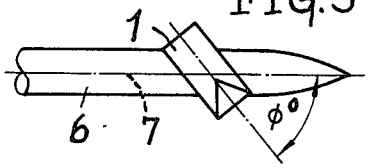
FIG. 3
FIG. 4
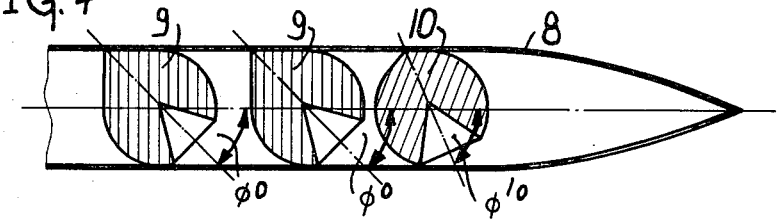
FIG. 5
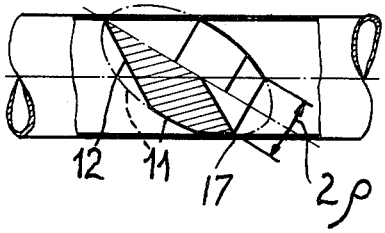
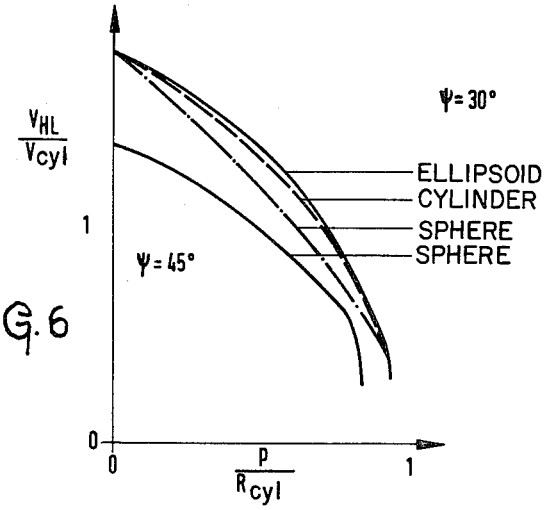
FIG. 6

FIG. 7
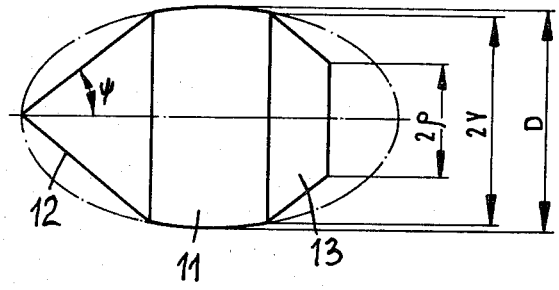
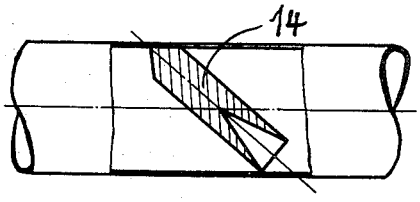
FIG. 8
FIG. 9
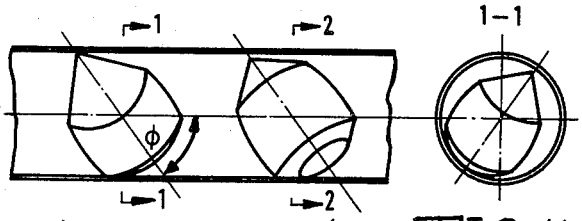
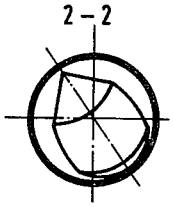
FIG. 11
FIG. 12
FIG. 10
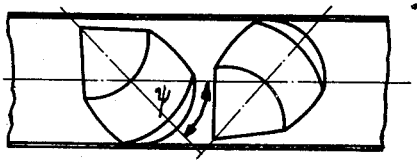
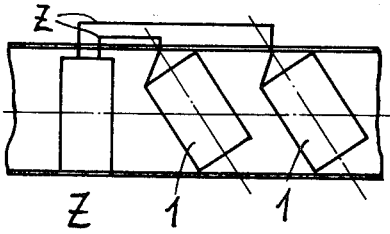
FIG. 13
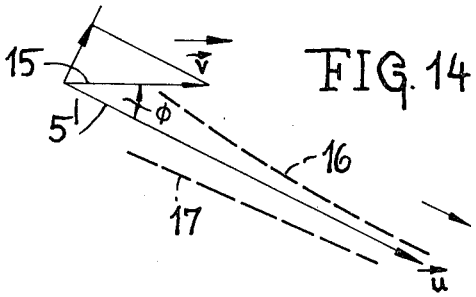
FIG. 14

FIG. 15
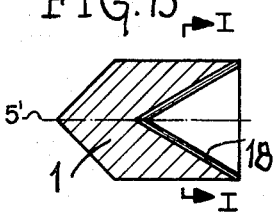
FIG. 16
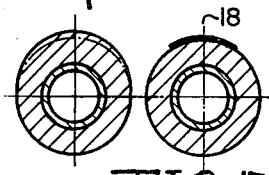
FIG. 17
FIG. 18
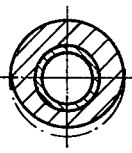
FIG. 19
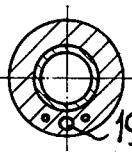
FIG. 20
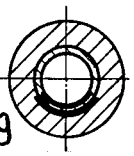
FIG. 21
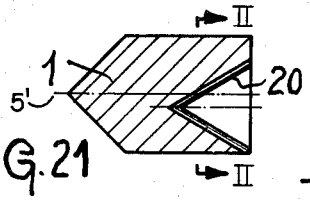
FIG. 22
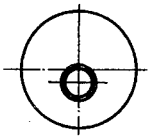
FIG. 23
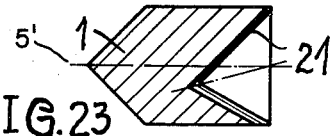
FIG. 24
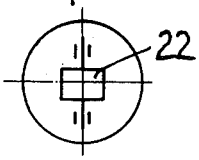
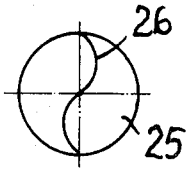
FIG. 26
FIG. 25
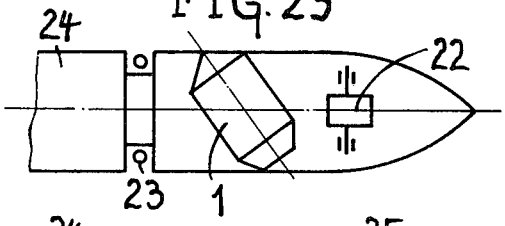
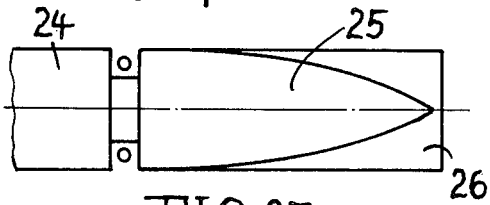
FIG. 27

WARHEAD FOR ANTITANK MISSILES FEATURING A SHAPED CHARGE

BACKGROUND AND SUMMARY OF THE INVENTION

The invention relates to warheads for anti-tank missles of the type featuring at least a shaped charge.

Warheads featuring shaped charges are well known, and exert their effect upon the armor plating of an armored vehicle essentially in the direction of the warhead axis or in the direction of the trajectory tangent. Correspondingly, the development of armor plating for armored vehicles has led to the use of inclined plates for protection of the interior of the armored vehicles because it has become known that the available path in the armor increases according to the plate angle and, additionally, there appears to be an improved protection against kinetic energy rounds due to the expectation of ricochet increasing with the inclination, and in the case of the hydrodynamic penetration of a shaped charged jet, the transient phase of the penetration or emergence of the jet is extended, thereby adversely affecting the penetration capability.

Furthermore, it has been determined that still further protection is achieved by a distribution of the plate thickness between a number of plates with intervals or spaces between each of the plates because the abovementioned transient penetration phase appears again with each plate.

Recent considerations with respect to the modification of the plate material as well as the so-called active armor arrangements utilized the described angle effect. As a result, it appears that, although real armor platings with improved protective effect are not yet in military usage, the prior shaped charge arrangements have lost their significance. This effect would also appear to be true, not only for shaped charge projectiles, but also for hypervelocity rounds. The consequence of this is that the improved protective effect described above must be coped with by an increase in the size of the caliber, according to prior art concepts, whereby the weapon becomes heavier.

Accordingly, an object of the present invention is to create warheads for anti-tank missles which will produce a sufficient internal effect in complex armor platings with a minimum of mass.

According to preferred embodiments according to the present invention, the above-noted object is achieved by utilization of at least one shaped charge which has its longitudinal axis shifted angularly downward in its stabilized in flight attitude with respect to the axis of the warhead, and accordingly, the trajectory tangent.

By so orienting the shaped charge, the jet of the shaped charge is able to impact the armor plating essentially perpendicular with respect thereto, the path is reduced to a minimum, and the transient phases of penetration are extensively avoided.

If a determination is made of the solid angle of the perpendicular to the actual armor plating of the combat vehicle for all directions of attack, then the purpose of achieving an approximately perpendicular impact of the jet upon the armor plating is achieved by adjusting the angle of the shaped charge, according to a preferred arrangement, to about 35 degrees with respect to the trajectory tangent so that this angle represents an optimum because the arrangement of the inclinations of the armor plating levels of various types of combat vehicles cannot be predicted.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 illustrates the location of a shaped charge at the instant of its detonation and its effect on two armor plates which are separated from one another, inclined and parallel to each other, according to prior art arrangements;

FIG. 2 shows the location of a shaped charge which takes effect approximately perpendicularly, in accordance with the present invention, on armor plates as shown in FIG. 1;

FIG. 3 is a diagram of a warhead with a shaped charge arranged with an angle in accordance with the present invention;

FIG. 4 is a side view of a warhead with three shaped charges having axes which run at different angles;

FIG. 5 is a warhead component having an essentially ellipsoid shape;

FIG. 6 is a diagram on whose abscissa is the ratio of the base radius of the cavity lining to the radius of the warhead cylinder and whose ordinate represents the degree of filling, i.e. the ratio of volume of the shaped charge to the volume of the part of the warhead cylinder containing this shaped charge;

FIG. 7 is a representation of an ellipsoid shaped charge which is truncated at both ends by conical surfaces;

FIG. 8 is a representation of a relatively narrow shaped charged in a warhead cylinder;

FIG. 9 illustrates the vertical projection of two shaped charges arranged in a warhead cylinder, shown in a horizontal in flight attitude, with a horizontal oblique angle to the left and right in addition to a vertical inclination;

FIG. 10 is the horizontal projection of the form of construction of FIG. 9;

FIG. 11 is a cross-sectional view according to line 1—1 of FIG. 9;

FIG. 12 is a cross-sectional view along line 2—2 of FIG. 9;

FIG. 13 shows igniter leads passing from one initiator to the initiating points of two shaped charges;

FIG. 14 is a diagram of the jet in the target-stable system, on one occasion bent without compensation and on the other occasion with compensation together with the assumption that this compensation of the guidance speed is successful;

FIG. 15 is a longitudinal section through a shaped charge;

FIGS. 16 through 20 are a number of forms of construction of shaped charges which are symmetric with respect to a central longitudinal plane, but otherwise asymmetric;

FIG. 21 is a longitudinal section through a shaped charged having an axially offset lining;

FIG. 22 is a cross-sectional view along line II—II FIG. 21;

FIG. 23 is a shaped charge having a lining whose axis encloses an angle with the axis of the shaped charge;

FIGS. 24 and 25 are longitudinal and cross-sectional views through a warhead which is supported rotatively upon a missle and is attitude controlled by a gyro; and FIGS. 26 and 27 are an end view and a side view, respectively, of a warhead supported rotatively upon a missle with stabilizing fins provided on the outer casing of the warhead.

DETAILED DESCRIPTION OF THE PREFERRED EMBODIMENTS

As illustrated in FIG. 1, a shaped charge 1 is arranged, according to prior art concepts, at an angle of $\alpha$ degrees shortly before its initiation with respect to armor plates 2, 2' which are spaced with respect to each other. The effect of the shaped charge is affected by the form of the penetrations 3 and 4, whereby, in the entry area, the axis of the shaped charge's jet (indicated by the line 5) runs in the vicinity of the bottom side of the penetration 3, and in the exit area runs in the vicinity of the top side of the penetration 4. Thus, the space available for passage of the shaped charge's jet is relatively small.

If FIG. 1 is compared with FIG. 2, it can then be seen that, in the case of the present invention, the axis of movement of the shaped charge's jet runs concentrically with respect to the penetrations 3' and 4' so the jet has sufficient space for its movement therethrough.

If the available paths of FIGS. 1 and 2 are compared with one another, it can be seen that, for example, in the case of an angle of 30 degrees for 60 between the shaped charge axis 5 and the plate surface, the path is double that represented in the case of the normal impacting according to the present invention illustrated in FIG. 2.

Since the penetration depth is approximately proportional to the diameter of the shaped charge, this means the shaped charge with a smaller caliber in the case of a steeper impact shows the same penetration probability as a charge of larger caliber which is not fully effective due to its angle of incidence with respect to the plates. However, taking into consideration the required internal effect which should be at least equal or better, independent of the protective effect of the armor plating, it is not advisable to reduce the caliber size to half the usual size.

Roughly calculated computations show that the anticipated value of the solid angle between the shaped charge axis and the plate surface depending on the azimuth rotation of the plate averages overall angles of rotation for $\alpha$ of between 0 and 90 degrees and makes necessary an oblique angle of $\psi$ between the trajectory tangent and the shaped charge axis in planes spaned by both of ca. 30 degrees to 45 degrees. This plane is preferentially directed perpendicular to the surface of the earth since, owing to an additional lateral obliqueness, the solid angle is worsened.

Naturally, the angle of attack can be partially compensated by additional horizontal obliqueness around the angle $\psi$ which, however, means a corresponding worsening for the reflected attack direction which is probably the same. Nevertheless, the horizontal oblique angling must not be disregarded if it appears necessary, as shown later, to divide up the previous shaped charge into a number of sectional charges. It is then possible to achieve advantages by paired sectional charges with shaped charge axis rotated horizontally to the left or to the right as the case may be. This oblique angle in the vertical is directed downward in order that this plate inclination can be compensated for, given averaged overall plate inclinations and attack directions.

The armored combat vehicles used today show a vertical rotation or inclination angle $\alpha$ of about 10 degrees to 70 degrees. An angle of attack of 0 to 90 degrees is sufficient in the horizontal lines. Depending upon the ratio of the vehicle length to width, as well as the thickness and inclination of the front or side, there results a minimum penetration expectation for horizontal angles of attack ranging between 35 and 45 degrees, i.e., approximately in the direction of the diagonals of the combat vehicle so that, for example, a round on the front or on a side surface of the combat vehicle leads with a higher reliability to penetration than in the direction of a diagonal of a combat vehicle. It follows from the above that the shaped charge axis in the vertical plane should be directed downward so that the angle $\phi$ between the axis of the shaped charge and longitudinal axis of the warhead should be directed downward in a vertical plane between 15 degrees and 50 degrees, and preferably 30 degrees to 45 degrees, (see FIGS. 1-3, it being noted that the orientation of the axis of the warhead is the same for both of the FIGS. 1 and 2 arrangements and for purposes of illustrating the angle $\phi$ in FIG. 2, the line 5 of FIG. 1 has been extended so as to represent the warhead axis 7 shown in FIG. 3.)

FIG. 3 shows the schematic construction of a warhead 6 provided with a shaped charge 1. The shaped charge 1 is arranged tilted with an angle $\phi$ with respect to the longitudinal axis 7 of the warhead. Since such an arrangement leads to aerodynamic disadvantages, such shaped charge is accommodated in warhead cylinder 8. In the case of the form of construction of FIG. 4, three essentially spherically shaped charges 9, 9 and 10 are accommodated in a cylinder 8. Both of the shaped charges 9 have the same form and are arranged with the same angle $\phi$, whereas the angle $\phi'$ of the shaped charge 10 is different, and in the case of the particular example illustrated, is greater than the angle $\phi$ of the charges 9. 9.

The shaped charge 10 is also differentiated from shaped charges 9 by a smaller cone being imposed upon the spherical shape thereof so that it can be seen that the form of the charge is a function of the size of the inclination angle $\phi$. The greater the angle of inclination $\phi$, the smaller the conical surface formed upon the shaped charge. The result is that, with a minimum of modifications, an improvement in the shaped charge effect can be achieved, whereby it is useful to preserve a prescribed warhead caliber. The construction of the inclined shaped charge is accordingly accommodated in the caliber cylinder and, as FIG. 4 shows, this is most easily achieved using spheres whose diameter practically corresponds to the caliber of the warhead. If a basically spherical shaped charge is considered, it follows that its axis could enclose any desired angle upon to the transverse position with the warhead cylinder axis. Thus, if the angle $\phi$ is greater than zero degrees but is less than 90 degrees, it follows that there can be added to the sphere volume a cone tangent to the sphere with the tip and the cylinder jacket up to the penetration point of the shaped charge axis through the cylinder jacket of the warhead. The volume of the shaped charge composed of a sphere and cone, thus depend on the angle $\phi$, can be related to the required caliber cylinder section which results in a volumetric efficiency $V_{HL}/V_{Cyl}$.

The inclined shaped charges illustrated for sake of example in FIG. 4, each with one cone and one sphere, represent the useable solution, but not the best solution. It is, therefore, advisable to use instead of the caliber sphere, an ellipsoid 11 around the shaped charge axis with a connecting cone 12 retained in a cylinder jacket as illustrated in FIG. 5. This charge has the highest possible volume and the greatest possible cavity-base diameter. If the load volume is plotted over the base radius $\rho$ of the cavity 15, the superiority of the cone-ellipsoid charge can be seen in comparison to the cone-cylinder or cone-sphere form as this is illustrated in FIG. 6. The differences are, however, not very great so that giving consideration to production of such charges, it should be more advisable to use a combination of cone and cylinder. Far more disadvantageous than the difference in shape between ellipsoid and cylinder is the effect of a shortening of the shaped charge because, while the radius $\rho$ increases, the volumetric efficiency of about 50 percent drops to 10 percent.

It is therefore possible as shown in FIG. 4, to arrange a number of charges sequentially in the warhead cylinder. Since the volumetric efficiency is about proportional to the mass ratio between an inclined shaped charge and an axis shaped charge, there is the possibility in the case of 50 percent volumetric efficiency to arrange two inclined shaped charges in the warhead cylinder so that the warhead mass is maintained; however, it is maintained at the cost of a lengthening of the cylinder, and accordingly, a lengthening of the profile of the original shaped charge warhead.

The consequence of the inclined shaped charged arrangement is therefore either a preservation of the original warhead profile with a descreased mass, or the maintainance of the warhead mass with a lengthening of the profile. Both lead to an unavoidable modification of the flight characteristics of the ammunition. It is thereby clear that a selection of actions to be carried out can only take place for each specific case.

The great variation of the width of the base radius $\rho$ and the volumetric efficiency, with resultant change of charge length, leads to the question as to which length should be selected with regard to the penetration capacity. On an approximate basis, the penetration depth of a shaped charge is proportional to the radius of the base. In addition, the explosive mass is also involved whereby it is clear that a very long explosive column hardly increases the penetration depth. There is accordingly involved a mass function, or, in the case of a given density of the explosive charge, a volume function, so that it is clear that neither the largest base nor greatest volume of charge can result in optimum penetration depths. The optimum penetration depth is produced with a charge consisting of a cone 12 on the initiation side connecting to the ellipsoidal or to the cylindrical part and a truncated cone 13. The truncated cone is produced by separation of the cone tip shown on the right in FIG. 7. The cone 12 and the truncated cone (conic frustrum) 13 are seated on the base radii Y of the ellipsoid 11 or the corresponding radii of the cylinders in a case of a cone cylinder shaped charge. The greatest diameter of the ellipsoid is D.

It is advisable to ensure that the diameter $2\rho$ shaped charges smaller cross section ranges between 70 percent and 90 percent of the truncated cone base diameter 2Y.

The ratio of $\rho$ to Y in the case of $\phi$ equals 30 degrees fluctuates between 0.75 and 0.81 or as in the case of $\phi$ equals 45 degrees, it fluctuates between 0.78 and 0.85.

These percentages grow somewhat with the angle of inclination. Thus, this percentage amounts to 78 percent in the case of an inclination of 30 degrees whereas it amounts to 81 percent in the case of an inclination of 45 degrees.

If the deviation is made from charge diameter 2Y, it follows that shaped charges can also be made with a smaller diameter within the longitudinal ellipsoid so that longer and narrower charges can be installed in greater number. This would then be an advantage if the required penetration capacity against weak armored targets is relatively small as this is indicated by the relatively narrow shaped charge 14 shown in FIG. 8.

If on the other hand, the target is relatively heavily armored, it is proposed to install sectional charges in the warhead which alternate to the left and to the right in the horizontal plane adjusted with the oblique angle $\psi$ in addition to vertical inclination of the angle $\phi$, whereby both angles show comparable quantity as this is depicted in FIGS. 9 to 12.

This has the effect that half of the sectional charges no longer have an opportunity to produce a penetration, but penetrations are produced then by those charges with which $\psi$ compensates for the azimuth angle of incidence of the target, whereas in the case of $\psi$ equals 0, shaped charges as indicated above are only successful in the case of angles of attack lying vertical or normal to the target surface. In order to initiate sectional shaped charges designed in the above described manner, it is proposed to accommodate the ignition system with corresponding safety installations separated from the sectional charges and to institute the initiation, for example, by electrical, flame jet, or detonative lines attached at the cone tips of the individual sectional charges (FIG. 13). This makes it possible to cause the sectional charges to act on a time-delayed basis with only one ignition system, since otherwise, adjacent charges would be adversely affected in their effect. If a shaped charge axis 5' with trajectory tangent 15 encloses the angle $\phi$, it follows that the velocity u of a jet element is overlapped in the direction of the direction of movement 5' of the jet having velocity v of the missile in the direction of trajectory tangent 15. In the axial direction of the shaped charge, there results thereby a slightly increased particle velocity which has practically no effect on the penetration capacity. However, the component of v affects a deviation of the jet element from the axis so that sequentially following particles no longer impact in the crater base but impinge laterally on the same or strike the crater wall or hit outside of the crater depending on how strong the component is. Owing to this effect, the applicability of the inclination of shaped charges to the trajectory tangent both insofar as concerns v as well as $\phi$ is restricted. High-speed warheads could, accordingly, only be slightly inclined and, in the case of rather large inclinations, only very slow warheads could be used.

In order to provide compensation in this respect, it is another aspect of the present invention to modify the intrinsically rotational-symmetrical design of the shaped charge so that a charge is produced which is symmetrical with respect to a longitudinal plane, but is otherwise asymmetrical. In previous proposals of the applicant, such plane-symmetrical deviations of the shaped charge jet were described. If a shaped charge were modified in such a manner that the rotational symmetry passes over into a plane symmetry, for example, lateral thickening or attachment of parts, it follows that the jet is caused to deviate from the axis owing to these fluctuations. This effect can be used in order to compensate for the warhead velocity. Although all particles of the jet demonstrate differing velocity, u, the resultant of u and v, accordingly, in different directions, it is nevertheless only necessary to distribute approximately the same transverse components to all particles in order to thereby again achieve an axial flight of the jet. If a measure were conceived which gave all jet elements the same transverse velocity, it follows that such charge, exploded without further complication, would show an axis-parallel shifted jet profile.

The dashed line 16, in FIG. 14, shows the profile of the jet without any compensation owing to the effect of the guidance speed V and the angle $\phi$, whereas the dashed line 17 shows the corresponding profile with compensation shown somewhat parallelly offset to the jet direction of movement 5'.

The transverse velocity can easily be determined using flash radiographs. In this case, it is simpler from the test-engineering standpoint to develop the required modification to the symmetry of the charge.

In addition, it is helpful that, in accordance with experience, the slow jet components hardly deepen the crater so that the high-speed jet elements must be compensated for only from the tip of the jet with ca. 8500 m/s to 3000–400 m/s. The compensation takes places owing to the effect of a pulse on the lining component (ring) arising from the jet element. Two possibilities are available:

1. Various pulse densities on the circumference of the ring,
2. Various times of arrival of the uniformly distributed pulse (probably less easier to deal with).

It is proposed by means of possibility 1 to accomplish the compensation by increasing the quantity of explosive (in the area of lining) on a part of the circumference.

In place of the local reinforcement of the pulse by increased explosive, it is also possible to achieve the pulse intensitification by local confinement, for example, by applied lead foils.

Although an approximate computation of the transverse pulse is possible after extensive testing, it is still better for the practical solution to vary the local increase of the pulse on the basis of flash radiographs to such an extent until the particles fly off at the required distance from the axis and parallel to the latter.

As mentioned above, a number of ways are available for increasing the local pulse density, which will now be discussed in conjunction with FIGS. 15–23.

In the case of FIG. 15, a shaped charge 1 is provided with a lining 18 arranged symmetrical with respect to its longitudinal axis 5', and FIGS. 16–20 representing alternative cross-sectional views taken along line I—I of FIG. 15. The cross section according to FIG. 16 shows a thickening of the explosive charge upward. Since the shaped charge is constructed with an incline axis, this thickening is located forward.

FIG. 17 shows a partial confinement of the explosive charge by an inert mass such as lead foil. This partial confinement is located symmetrically with respect to the vertical longitudinal plane 16 and preferably encompassing approximately a 70 degree arc angle.

FIG. 18 shows antenuation of the explosive charge wall thickness in the lower cross sectional area, and accordingly, it is located behind the axis in the case of the inclined installation status.

FIG. 19 depicts antenuation in the lower area located behind the axis with respect to the direction of movement of the warhead and is achieved through the use of cavities 19. FIG. 19 shows that this compensation is also achievable by a reinforcement of the lining wall thickness.

FIGS. 21 and 22 show another possibility for compensation, wherein the lining 20 is shifted axially parallel with respect to the shaped charge axis 5'.

In the case of the form of construction of FIG. 22, the axis of the lining 21 is inclined downward at an angle with respect to the axis of the shaped charge 5'.

These changes can also be combined when the accommodation of the sectional charges requires this. If, for example, no sufficient space is available for thickening it then follows that some explosive can be additionally taken away from the side located opposite or even the cone can be somewhat tilted. All changes in thickness should be done continuously and not on a step-by-step basis. It should additionally be mentioned that the desired transverse pulse can also be induced by a bending of the lining axis or by differences in thickness in the lining wall thickness.

It can be seen from the above that all actions described are only applicable when the warheads fly in a stable and non-rotating axis which is essentially true for guided missiles of the so-called first generation.

Most shells and missiles however rotate about their longitudinal axis, in part in order to stabilize flight by means of spin and in part to make ineffective any constructional inaccuracies and however, also, to be able to allow control forces to take effect on an all-around basis. As the specialist knows, shaped charge performance is adversely affected by a high spin so that proposals are well known, for example, in the case of spin-stabilized artillery rounds, to allow the charge itself not to take part in the rotation. In a similar way, it is proposed to produce an axis-stable position also for the inclined shaped charge or shaped charges as described herein, i.e., to apply the warhead component rotatable on the rotating missile with one or with several inclined shaped charges and the care of by forces of air or gyro 22 for keeping the warhead from rotating owing to friction in bearing 23 as this is shown in FIGS. 24 and 25.

This can also be achieved by providing the warhead 25, positioned on missile 24, with control surfaces 26 or the like, which take care of reducing to 0 the spin owing to air flowing therearound transmitted to the warhead through a bearing friction.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. In an anti-tank warhed for missiles of the type having at least one shaped charge, the improvement comprising said shaped charge being positioned within said warhead with its longitudinal axis directed downward forming an angle $\phi$ of 15 to 50 degrees with respect to the longitudinal axis of the warhead in a vertical plane, and the shaped charge being large enough to at least substantially span the inner diameter of the warhead.

2. A warhead according to claim 1, wherein the angle $\phi$ is between 30 to 45 degrees.

3. A warhead according to claim 1, wherein said shaped charge is in the form of an ellipsoid truncated by a conical surface, said longitudinal axis of the shaped charge being the axis of rotation for said ellipsoid and conical surface.

4. A warhead according to claim 1, wherein said shaped charge is in the form of a sphere truncated by a male conical surface being imposed thereon.

5. A warhead according to claim 1, wherein said shaped charge is in the form of a cylinder truncated by a conical surface.

6. A warhead according to claims 1 or 2 or 3 or 4 or 5, wherein conical surfaces are provided at both ends of said shaped charge.

7. A warhead according to claim 6, wherein one of said conical surfaces is frusto-conical.

8. A warhead according to claim 7, wherein said conical surfaces have base ends directed toward each other, and wherein the smallest diameter defined by said frusto-conical surface is between 70 and 90 percent of the diameter of its base diameter.

9. A warhead according to claim 6, wherein a plurality of said shaped charges are positioned within a cylindrical portion of the warhead.

10. A warhead according to claim 1, wherein a plurality of said shaped charges are positioned within a cylindrical portion of the warhead.

11. A warhead according to claim 10, wherein the diameter of said shape charges is relatively narrow in comparison to the length of the shaped charges.

12. A warhead according to claim 10, wherein a number of said shaped charges of a first shape are positioned at the same angle $\phi$ at different locations along said longitudinal axis and an additional shaped charge of a second shape is positioned forward of said number of shaped charges, the angle $\phi$ of said additional shaped charge being different than that of said number of shaped charges.

13. A warhead according to claim 12, wherein each of said plurality of shaped charges is in the shape of a body of revolution truncated at one end by a male conical surface, wherein the angle $\phi$ of said number of shaped charges is less than the angle $\phi$ of an additional shaped charge and the conical surface of said number of shaped charges is greater than the conical surface of said additional shaped charge.

14. A warhead according to claim 13, wherein said body of revolution is a sphere.

15. A warhead according to claim 4 or 14, wherein said sphere is of a diameter corresponding substantially to the caliber of the warhead.

16. A warhead according to claim 13, wherein said body of revolution is an ellipsoid.

17. A warhead according to claim 12, wherein said shaped charges are positioned within said warhead with their longitudinal axis forming an angle 104 with respect to the longitudinal axis of the warhead, said angle $\psi$ being rotated 90 degrees with respect to said angle $\phi$, the $\psi$ of adjacent shaped charges being oppositely directed with respect to the longitudinal axis of the warhead.

18. A warhead according to claim 10, wherein said shaped charges are positioned within said warhead with their longitudinal axis forming an angle $\psi$ with respect to the longitudinal axis of the warhead, said angle $\psi$ being rotated 90 degrees with respect to said angle $\phi$, the $\psi$ of adjacent shaped charges being oppositely directed with respect to the longitudinal axis of the warhead.

19. A warhead according to claim 10, wherein ignition means for igniting said shaped charges with differing delay times is provided connected to said shaped charges, thereby preventing interference between the effects of adjacent shaped charges.

20. A warhead according to claim 1 or 10, comprising means for compensating for the shaped charge axis related component of warhead speed, said means for compensating being formed by an asymmetry in the shape of the shaped charge.

21. A warhead according to claim 20, wherein said asymmetry is formed by a thickening of a portion of an explosive wall of said shaped charge.

22. A warhead according to claim 20, wherein said asymmetry is formed by a local confinement of a portion of an explosive wall of said shaped charge by inert masses.

23. A warhead according to claim 20, wherein said asymmetry is formed by a weakening of an explosive wall of said shaped charge.

24. A warhead according to claim 20, wherein said shaped charge has a lining within an explosive wall and said asymmetry is formed by a reinforcement between said lining and said explosive wall.

25. A warhead according to claim 20, wherein said shaped charge comprises a lining and an explosive wall, and wherein said asymmetry is formed by said lining being positioned within said explosive wall so as to be at least partially offset with respect to the longitudinal axis of the shaped charge.

26. A warhead according to claim 1, wherein the shaped charge is provided with a conic end forming a tip, said tip being engaged within a cylinder jacket of said warhead.

27. A warhead according to claim 26, wherein said tip is engaged in said cylinder jacket at most up to the penetration point of the shaped charge through the cylinder jacket.

28. In an anti-tank warhead for missiles of the type having at least one shaped charge, the improvement comprising said shaped charge being positioned within said warhead with its longitudinal axis being directed downward forming an angle $\phi$ of 20 to 50 degrees with respect to the longitudinal axis of the warhead in a vertical plane, and the shaped charge being large enough to at least substantially span the inner diameter of the warhead.

29. A warhead according to claim 1 or 28, wherein said shaped charge is in the shape of a sphere truncated at one end by a male conical surface and at an opposite end by a female conical surface.

30. A warhead according to claim 1 or 28, wherein the angle $\phi$ is 35 degrees.

31. A warhead according to any of claim 1 or 4 or 12 or 14 or 24, wherein the warhead is rotatably supported upon a missile with the missile rotating whereby a stable position of the warhead with respect to the axis is ensured by means such as fins or gyros.

* * * * *